US005203857A

United States Patent [19]

Terwilliger et al.

[11] Patent Number: 5,203,857

[45] Date of Patent: Apr. 20, 1993

[54] GAS COMPRESSOR HEAD AND DISCHARGE VALVE CONSTRUCTION

[75] Inventors: Gerald L. Terwilliger, Abington; Robert D. Douglas, Bristol, both of Va.; Prasanta K. Roy, Bristol, Tenn.; Milton M. Kosfeld, Bristol, Va.

[73] Assignee: Bristol Compressors, Inc., Bristol, Va.

[21] Appl. No.: 775,866

[22] Filed: Oct. 15, 1991

Related U.S. Application Data

[62] Division of Ser. No. 532,204, Jun. 1, 1990, Pat. No. 5,080,130.

[51] Int. Cl.[5] ..... F04B 21/04

[52] U.S. Cl. ..... 417/552; 417/570; 137/533.29

[58] Field of Search ..... 417/552, 547, 510; 137/533.27, 533.29, 353.15

[56] References Cited

U.S. PATENT DOCUMENTS 592,235 10/1897 Campbell ..... 417/552
1,454,347 5/1923 Stoms ..... 417/552
3,645,648 2/1972 Backman et al. ..... 417/552
4,023,467 5/1977 Thurner ..... 417/552
4,172,465 10/1979 Dashner ..... 137/533.27

*Primary Examiner*—Richard A. Bertsch
*Assistant Examiner*—Charles G. Freay

[57] ABSTRACT

A single or multi-cylinder compressor unit being cylinder wall ported and having suction inlet means to compression chamber means through the wall and top of piston means, wherein suction valve means comprises preferably a light-weight plastic disc means mounted in an essentially free-floating manner in the piston means top, the discharge valving cooperatively comprises discharge porting plate means and discharge valve disc means reciprocably mounted on bearing means in the compressor head for enhanced operating accuracy and seat longevity and adapted to seal discharge port aperture means in the plate means on the suction stroke, and wherein the piston means top, the compression side of the suction valve disc means, the compression side of the porting plate means, and the compression side of the discharge valve disc means all being adapted to lie substantially in the same plane at the apex of the compression stroke to essentially eliminate gas reexpansion.

6 Claims, 7 Drawing Sheets

GAS COMPRESSOR HEAD AND DISCHARGE VALVE CONSTRUCTION

FIELD OF INVENTION

This application is a divisional of Ser. No. 07/532,204 filed Jun. 1, 1990, now U.S. Pat. No. 5,080,130.

This invention concerns gas compressor construction having utility for compressing any gas, and having special utility for compressors of the type employed for refrigeration or air-conditioning systems including heat pumps and other air conditioning units for home or commercial use, wherein the compressor is electrically powered or mechanically powered as in automotive air conditioning systems, and wherein the compressor can be hermetically sealed, semi-hermetically sealed or open, and particularly concerns novel structural suction gas intake and discharge passage and valve design which afford substantial improvements in compressor operating characteristics including capacity and efficiency.

Such compressors as employed, for example, in closed-loop, central air conditioning or heating units, in window unit air conditioners or heating units, and in refrigeration units, are required to provide highly compressed refrigerant gas in a thermodynamically efficient manner which becomes quite difficult when load requirements increase the temperature of the compression system and effect a diminution in density of the suction gas being feed to and contained in the compression chamber. Also, it is desirable to keep the size and weight of such compressors to a minimum while engineering the unit to provide as much capacity and efficiency of operation as possible. Such engineering must take into consideration many factors in addition to that mentioned above, from both a structural and operational standpoint including inertia within the system, operating temperatures, resistance to damage by liquid refrigerant slugging, fatigue of metal or other parts through overflexing and the like, compressor and other noise sources, and capacity of gas flow passages.

The present invention has as its principal and general objects therefore, to provide a refrigerant gas compressor which is so constructed as to maintain a higher suction gas density than has heretofore been possible in equivalent equipment, and to thereby and by other structural innovations hereinafter described in detail, improve the overall operating capacity and efficiency of the compressor in a reliable and low cost manner.

BRIEF SUMMARY OF THE INVENTION

These and other objects hereinafter becoming evident have been attained in accordance with the present invention, some of the more prominent features of which are summarized in the context of a single or multi-cylinder compressor unit as a cylinder wall ported compressor unit having suction inlet means to compression chamber means through the wall and top of piston means, wherein suction valve means comprises preferably a light-weight plastic disc means mounted in an essentially free-floating manner in the piston means top, the discharge valving cooperatively comprises discharge porting plate means and discharge valve disc means reciprocably mounted on bearing means in the compressor head for enhanced operating accuracy and seat longevity and adapted to seal discharge port aperture means in the plate means on the suction stroke, and wherein the piston means top, the compression side of the suction valve disc means, the compression side of the porting plate means, and the compression side of the discharge valve disc means all being adapted to lie substantially in the same plane at the apex of the compression stroke to essentially eliminate gas reexpansion.

In supplementary manner and as described in detail below, further innovations in the structure of the compressed gas discharge porting and in the novel physical relationship of the above piston means to this discharge porting at the apex of the compression stroke markedly contribute to maximization of the compressor efficiency and to the full realization of the above objectives. The present invention is useful for single or multicyclinder compressors having a wide variety of structural designs and configurations.

DESCRIPTION OF PRIOR ART

Heretofore, cylinder wall porting of suction gas has been employed as shown, for example, in U.S. Pat. Nos. 2,033,437; 2,436,854; 3,490,683; and 3,915,597, however, due either to the configuration or placement of the porting, or to the type and complexity of suction valving employed, less than maximum thermodynamic efficiency and compressor capacity has been achieved through their use. It is noted that the U.S. Pat. No. 3,490,683 patent alludes to the desirability of cooler suction gas and adequate suction gas inlet flow, however, as is apparent from the principal inlet flow pattern adjacent to the hot cylinder head, the resistance of the spring closed inlet valve discs to inlet gas flow, and the limited volumetric capacity of the inlet passages, the structure proposed in this patent presents many operational deficiencies.

The invention in its broad aspects and in its preferred embodiments will be further understood from the following description and drawings, some of which figures are exaggerated in dimensions for clarity, and wherein.

Figure 16:
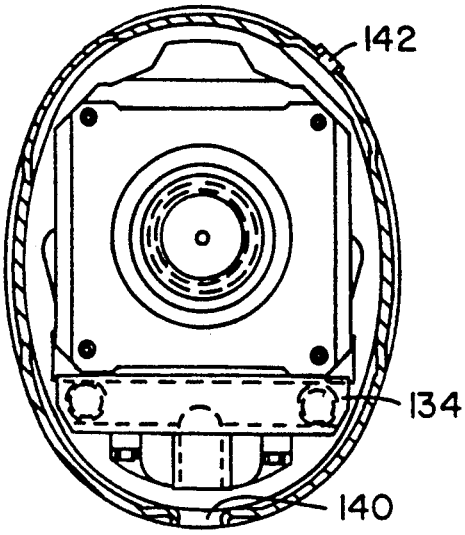
Figure 14:
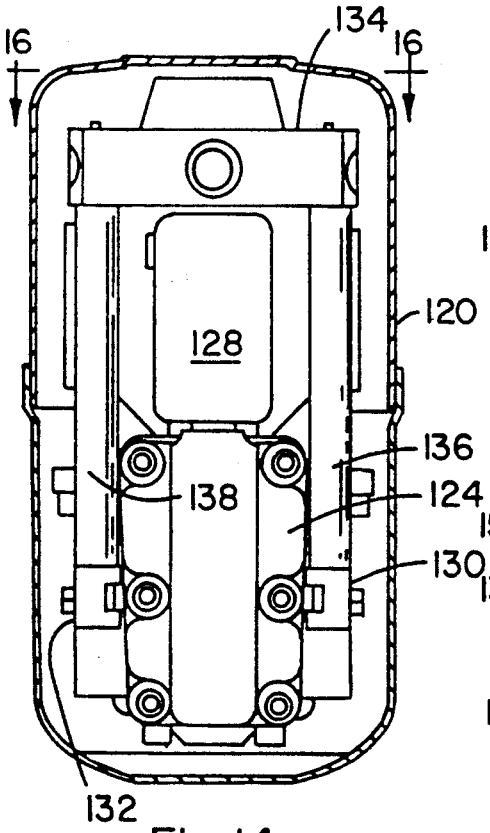
FIG. 14 is an elevational view of a compressor unit embodying the present invention with the housing in longitudinal cross-section and the unit viewed toward the compressor head.

FIG. 16 a view taken along line 16—16 of FIG. 14 in the direction of the arrows.

Figure 19:
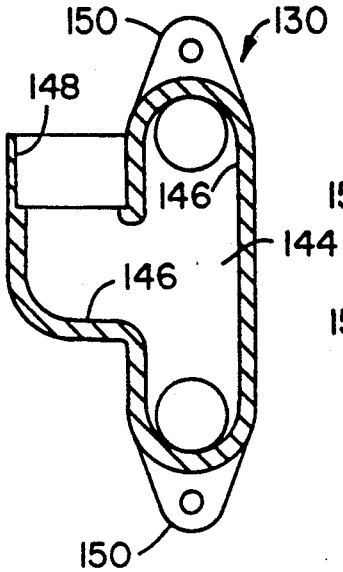
Figure 18:
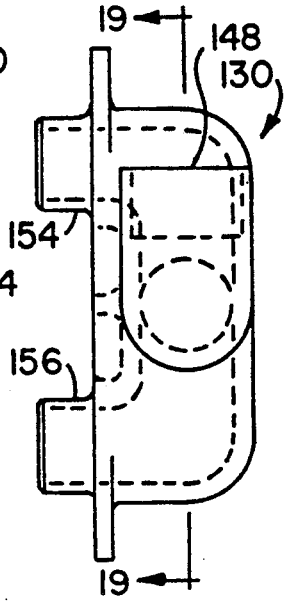
Figure 15:
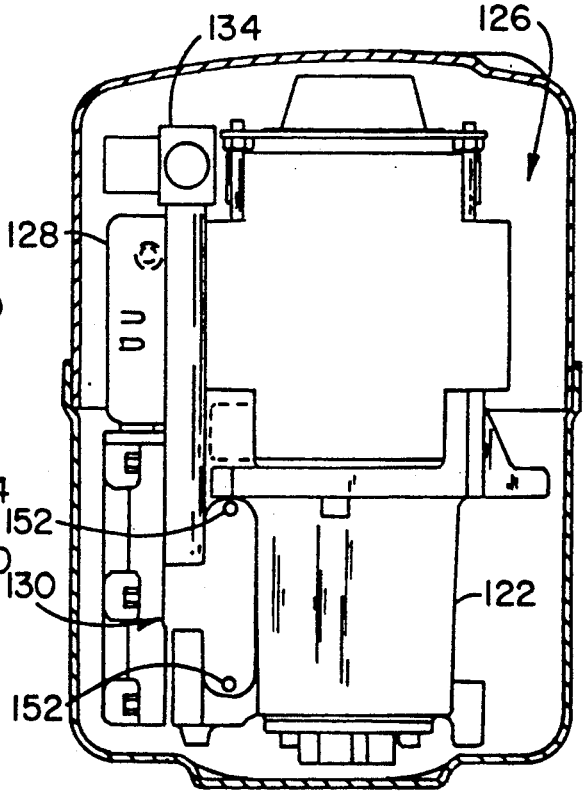
FIG. 15 is a view of FIG. 14 rotated axially clockwise 90 degrees.
Figure 17:
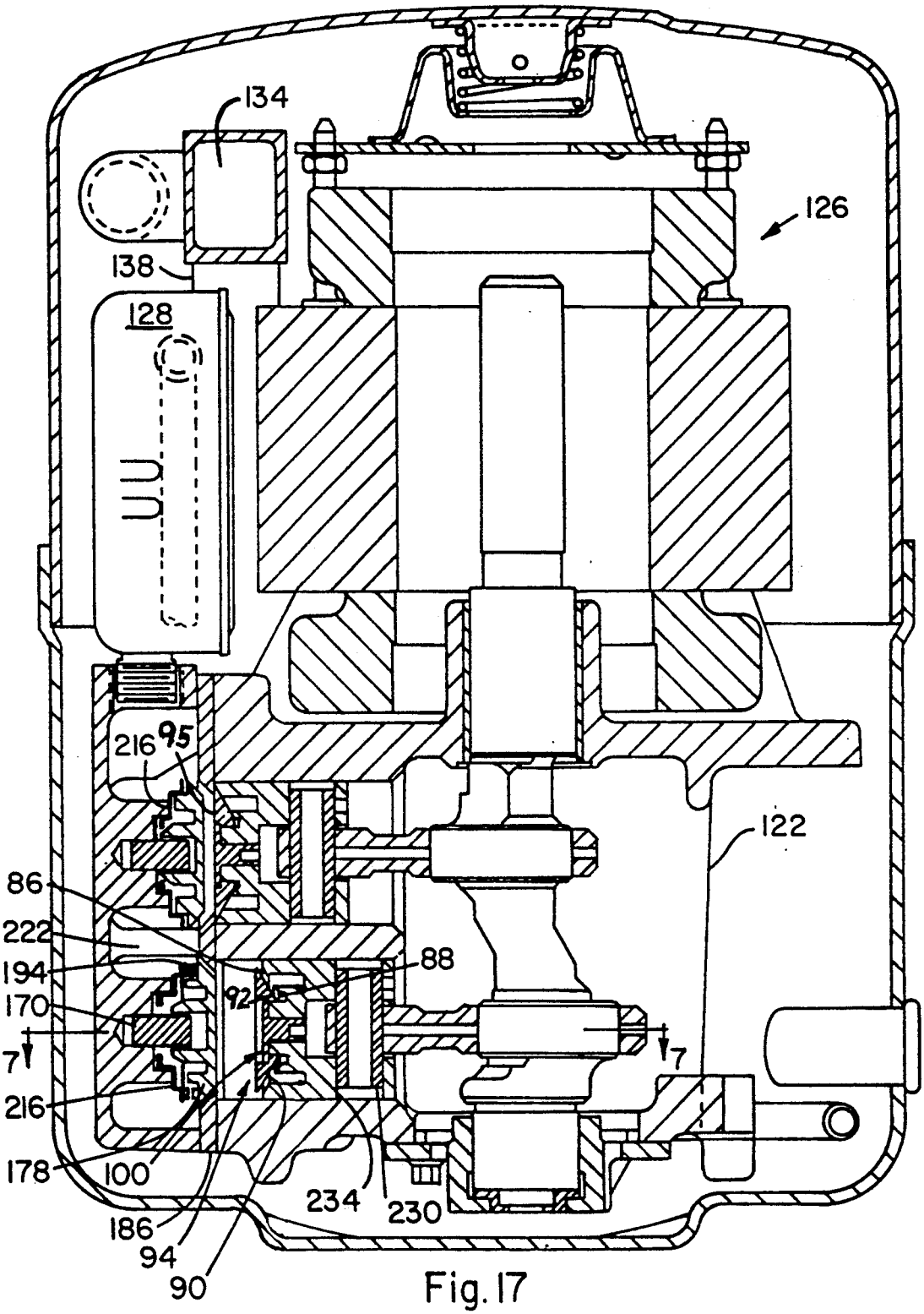
Figure 20:
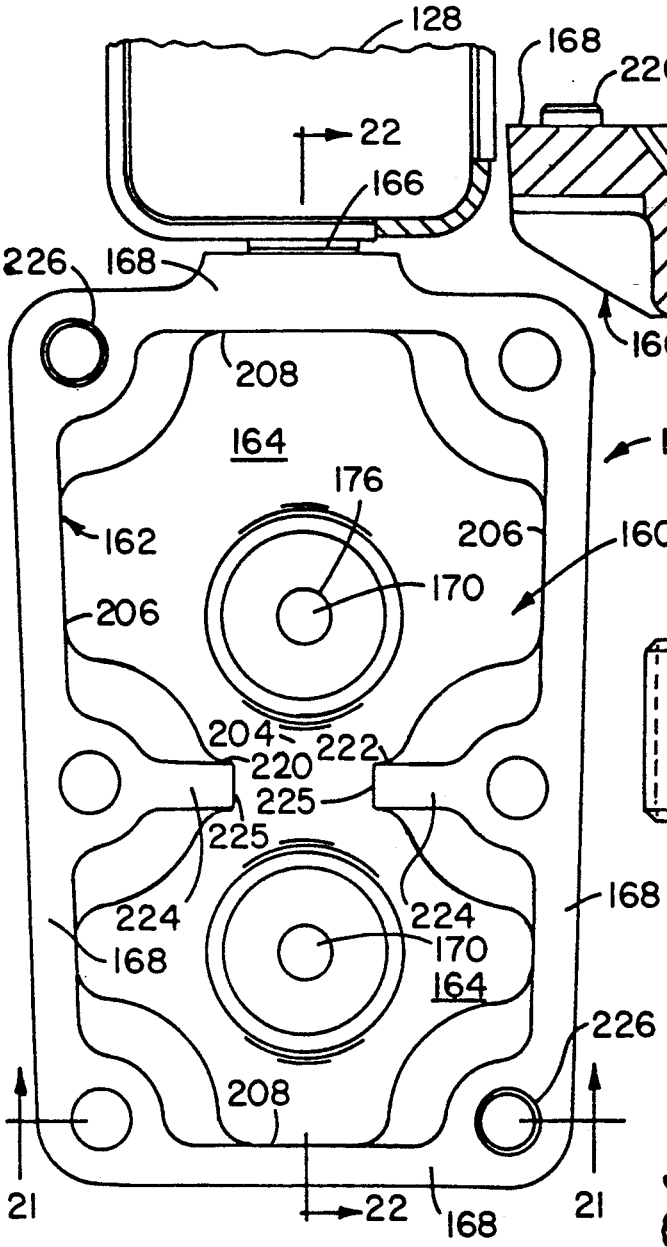
Figure 21:
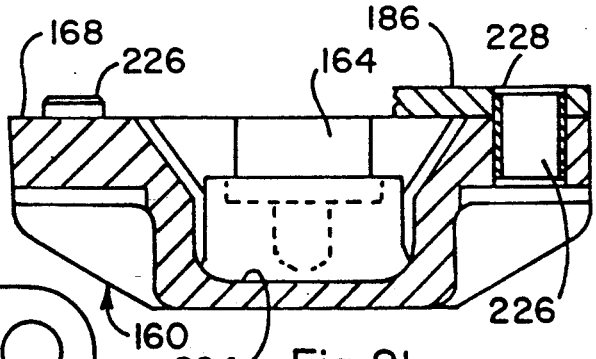
Figure 23:
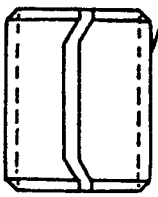
Figure 24:
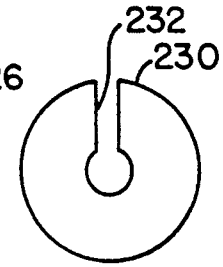
Figure 25:
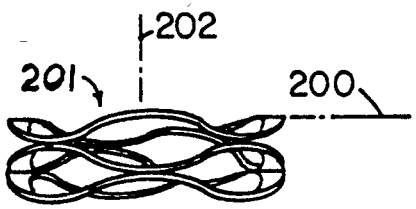
Figure 22:
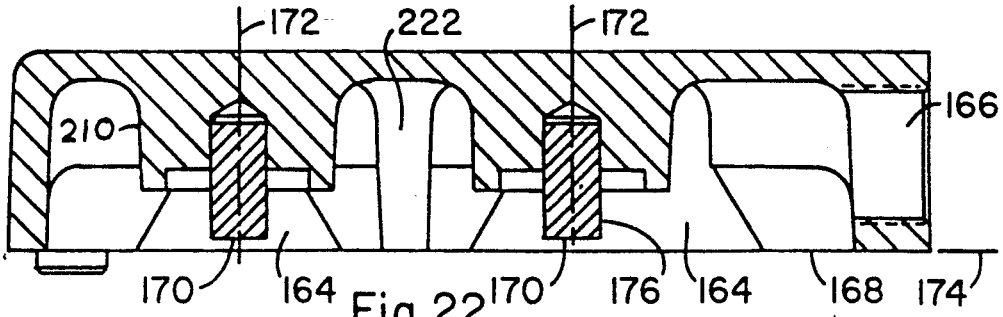

FIG. 17 is a longitudinal cross-sectional view of FIG. 15;

FIG. 18 is an enlarged elevational view of the right hand suction manifold of FIG. 14;

FIG. 19 is a cross-sectional view of the manifold of FIG. 18 taken along line 19—19 thereof in the direction of the arrows;

FIG. 20 is an elevational view of the cylinder head as viewed looking into the discharge cavity thereof;

FIG. 21 is a cross-sectional view of the cylinder head of FIG. 20 taken along line 21—21 thereof in the direction of the arrows;

FIG. 22 is a cross-sectional view of the cylinder head of FIG. 20 taken along line 22—22 thereof in the direction of the arrows;

FIG. 23 is a side elevational view of a split locator pin which is secured into through bolt holes in the compressor head;

FIG. 24 is a top view of the wrist pin, split retainer disc as shown assembled in FIG. 17; and FIG. 25 is a side elevational view of the preferred type of spring, crest-to-crest, for the discharge valves.

DETAILED DESCRIPTION OF INVENTION

Referring to the drawings, portions of a refrigerant compressor are shown comprising cylinder block 10 having a bore 12 formed therein in conventional fashion, a cylinder head 14, and a discharge porting plate 16 sandwiched and gasketed between the head block. A discharge valve 18 is axially slidably mounted on stud 20 of the head and continually urged by spring 22 toward seat 24 formed in porting plate 16 to isolate, in cooperation with the pressure differential across the discharge port, the compressed gas discharge chamber 26 from compression chamber 28 during the suction stroke of the piston.

With more specific reference to the present invention, the present piston generally designated 30 comprises a generally cylindrical body 32 formed with a wrist pin cavity such as shown as 34 and defined by straight walls 36, 38, tapered walls 40, 42, and roof 44, for accommodating the connection rod 46 and wrist pin 48 combination which pivotally connects the piston to the crankshaft in conventional manner. It is of course apparent that any conventional cavity configuration and connecting rod-wrist pin combination can be employed for the present novel piston.

Figure 1:
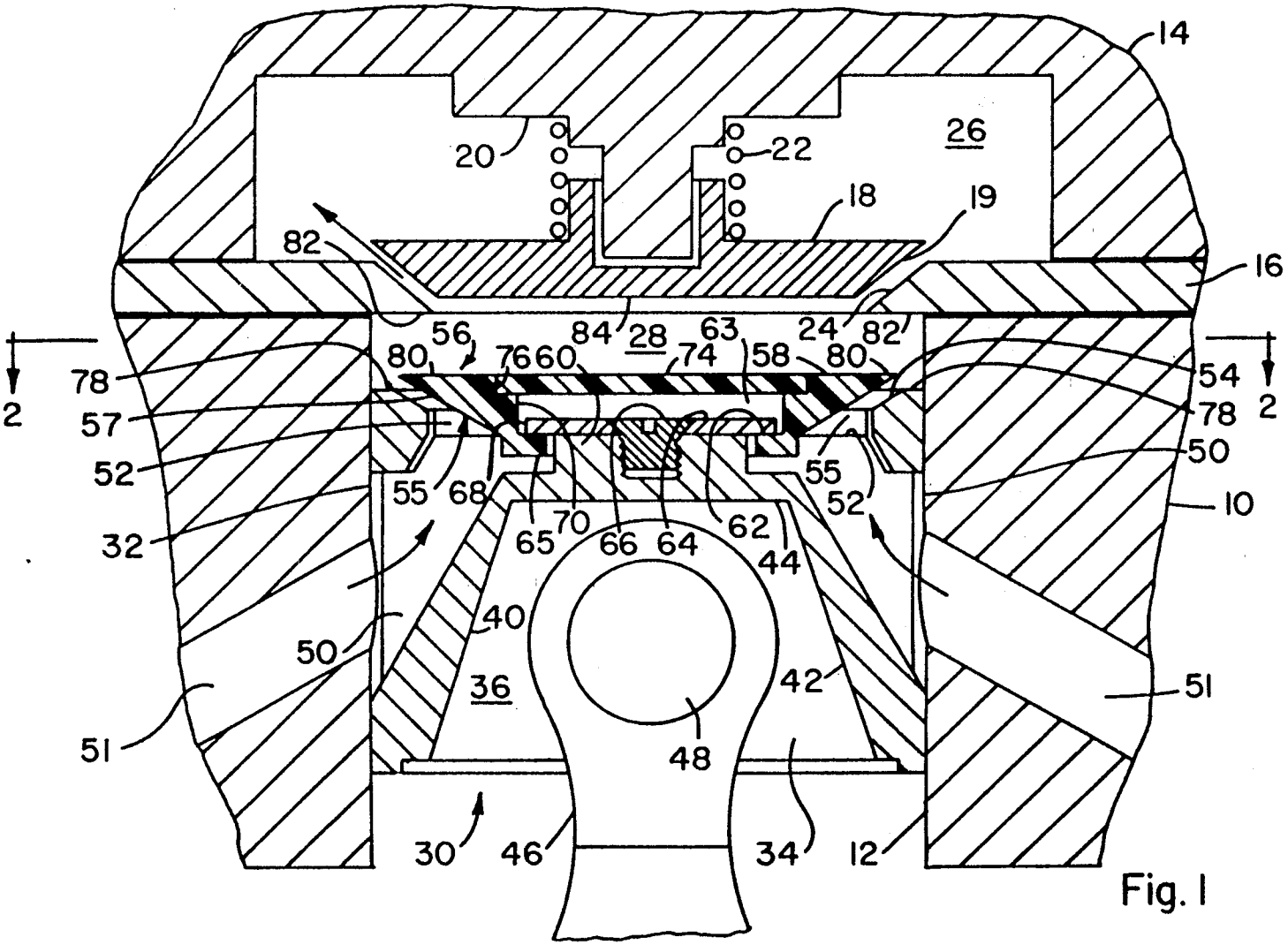
FIG. 1 is a cross-sectional side view of the relevant portions of a refrigerant compressor unit embodying the present invention.
Figure 5:
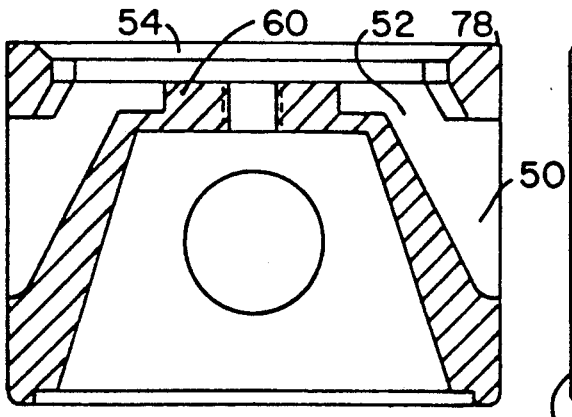
FIG. 5 is a view of the piston as in FIG. 1 with the valve disc and retainer removed for clarity and showing a through rivet aperture for affixing the retainer thereto.
Figure 3:
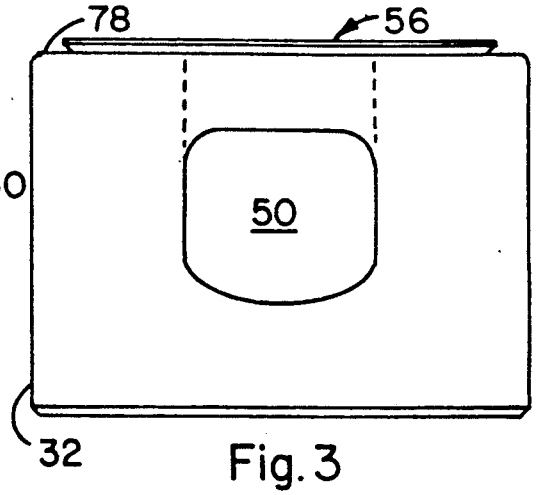
FIG. 3 is a side elevational view of the piston construction of FIG. 2 rotated 90° with the valve disc in its open position.
Figure 2:
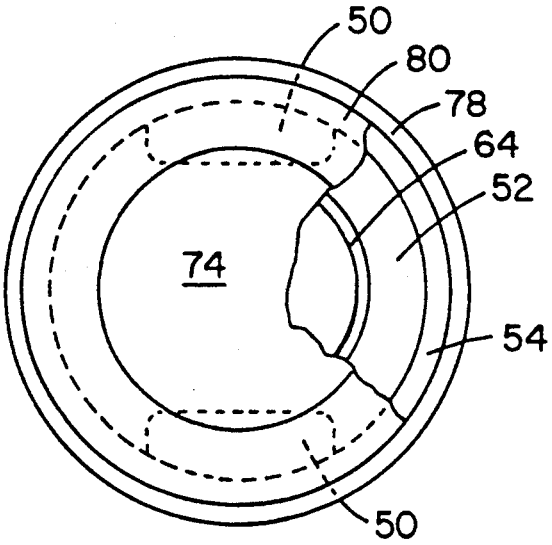
FIG. 2 is a view taken along line 2—2 of FIG. 1 in the direction of the arrows with a portion of the valve disc removed.
Figure 4:
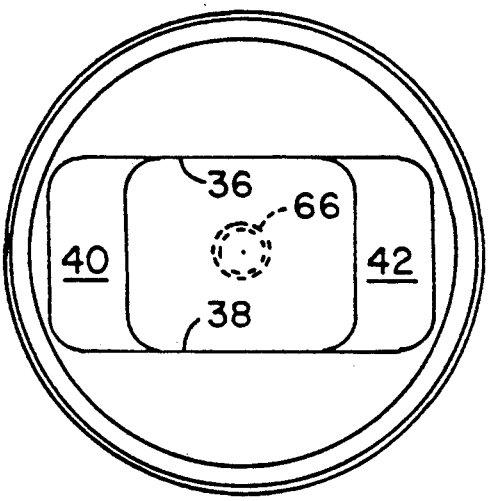
FIG. 4 is a view looking into the piston from the bottom.

Referring further to the drawings, the present piston is provided with gas passage means which, in the embodiment shown, comprises a pair of large apertures 50 cut through the outer wall of the piston body on opposite sides thereof and extending inwardly and upwardly to communicate with a large annular cavity 52 which lies upstream and adjacent to annular suction gas port seat 54 defining a suction gas port aperture generally designated 55. Apertures 50, over at least a substantial portion of their areas, are in continuous gas flow communication with suction gas inlets 51 through opposite sides of the cylinder wall. Inlets 51 are adapted, of course, to be in communication by way of suitable conduit means to suction gas returned into the compressor housing preferably into a suction gas plenum substantially isolated from motor heat. The valve disc generally designated 56, in the embodiment shown in FIG. 1, is as aforesaid, mounted on or in the top or upper portions of the piston for limited axial motion which is a floating motion unhindered by any structural restraints. The disc is preferably of a strong, fairly inflexible plastic material capable of withstanding operating temperatures and pressures and include such polymers as KADEL E-1230, a polyketone of Amoco Performance Products, Inc., of Ridgefield, Conn., or the "Vespel" or others disclosed in columns 3 and 4 of U.S. Pat. No. 4,368,755, or can be metallic or ceramic or combinations thereof. The manner in which the disc is floatingly secured to the piston may be greatly varied and the structure used in the drawing, although very effective, is only exemplary.

The valve disc 56 and its seat 57, and the port seat 54 defining the opening 55 through the top of the piston, provide the suction gas port means. For reasons hereinafter discussed in some detail, the upper surface or compression side 58 of the disc is preferably flat. In the exemplary embodiment shown, the top of the piston is formed to provide a circular shaft-like projection 60 over and around which an annular attachment flange 62 of the disc is loosely mounted. The flange preferably comprises a shoulder means formed outwardly from the wall 70 of bore 63 formed axially in the disc body, and lying adjacent the suction side 65 of the disc body. Other shaft-like shapes for projection 60 such as square or the like may also be employed. Retaining means which is shown for exemplary purposes as a flat circular retainer plate 64 secured to projection 60 by machine screw 66 or equivalent mechanical means such as rivet, bolt and nut, weld, braze or the like, is adapted to abut the upper surface of flange or shoulder means 62 to prevent complete axial removal of the disc from the piston. The periphery 68 of plate 64 is adapted to abut the bore wall 70 of the valve disc to prevent radial displacement of the disc and thus insure proper seating of the annular sealing surface or seat 57 of the valve disc on the port seat 54 on the compression stroke. In this particular structure of the valve disc a circular access cover 74 is provided to complete the planar upper surface of the disc. This cover, which is affixed to the disc body by any suitable means such as threads 76, screws, plastic welding (solvent gluing), sonic welding, or any combination of these or other convenient means, allows the disc to be readily molded substantially as a monolith and assembled on the piston. It is noted that the access cover 74 may also be of plastic coated steel or the like should excessive flexing of the plastic material per se occur and present a problem.

Figure 6:
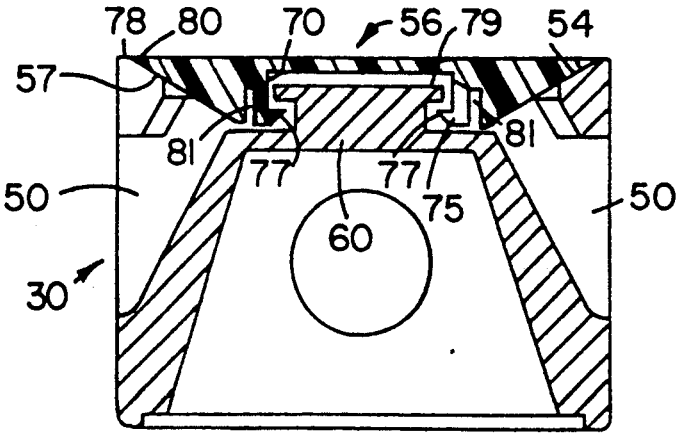
FIG. 6 is a cross-sectional view of the piston showing an alternative suction valve disc construction.
Figure 13:
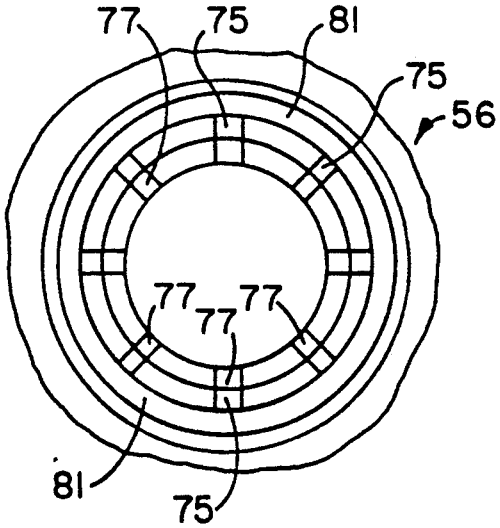
FIG. 13 is an elevational view of the valve disc of FIG. 6 viewed from the bottom or suction side.

In a preferred embodiment as shown in FIGS. 6 and 13, the valve disc 56 is a single molded piece provided on its lower side with a plurality of fingers 75 circumferentially spaced around the cavity formed by bore wall 70, the fingers preferably having beveled leading edges 77 for camming over the periphery of the annular retaining lip 79 preferably integrally formed on the equivalent of projection 60. An annular slot 81 formed in the bottom of the disc adjacent the radially outer edges of the fingers allows the fingers to flex radially outwardly they are pushed or snapped over the lip 79. A typical number of fingers for the disc size as shown is from about four to about sixteen. The flexible fingers alternatively may be provided on the peripheral portions of the retaining projection to provide equivalent snap-on capability, in which case, a member of suitable flexible material, e.g., plastic, can be secured to the top of the retaining projection to provide the flexible fingers operating in an up-side-down manner relative to the finger structure shown.

It is particularly emphasized here that in order for the effectiveness of the present invention to be realized to its maximum, the upper surface of the valve disc including the access cover should be essentially flat and lie in a single plane with the top or upper planar surface 78 of the piston when the valve disc is seated during the compression stroke. It is noted that surface 78 of the piston is planar even through it occupies a relatively small annular area, since all portions of the piston top adjacent the port seat 54 lie essentially in the same plane. This construction allows the top surface 78 of the piston and the radially outer portions 80 of the valve disc to be positioned immediately adjacent the annular inner surface 82 of the porting plate 16 such that the bottom surface 84 of the discharge valve 18, which is preferably shaped such that its compression side or surface 84 and the porting plate surface 82 can lie in a single plane, will lie immediately adjacent the upper surface 58 of the valve disc at the apex of the compression stroke.

Figure 7:
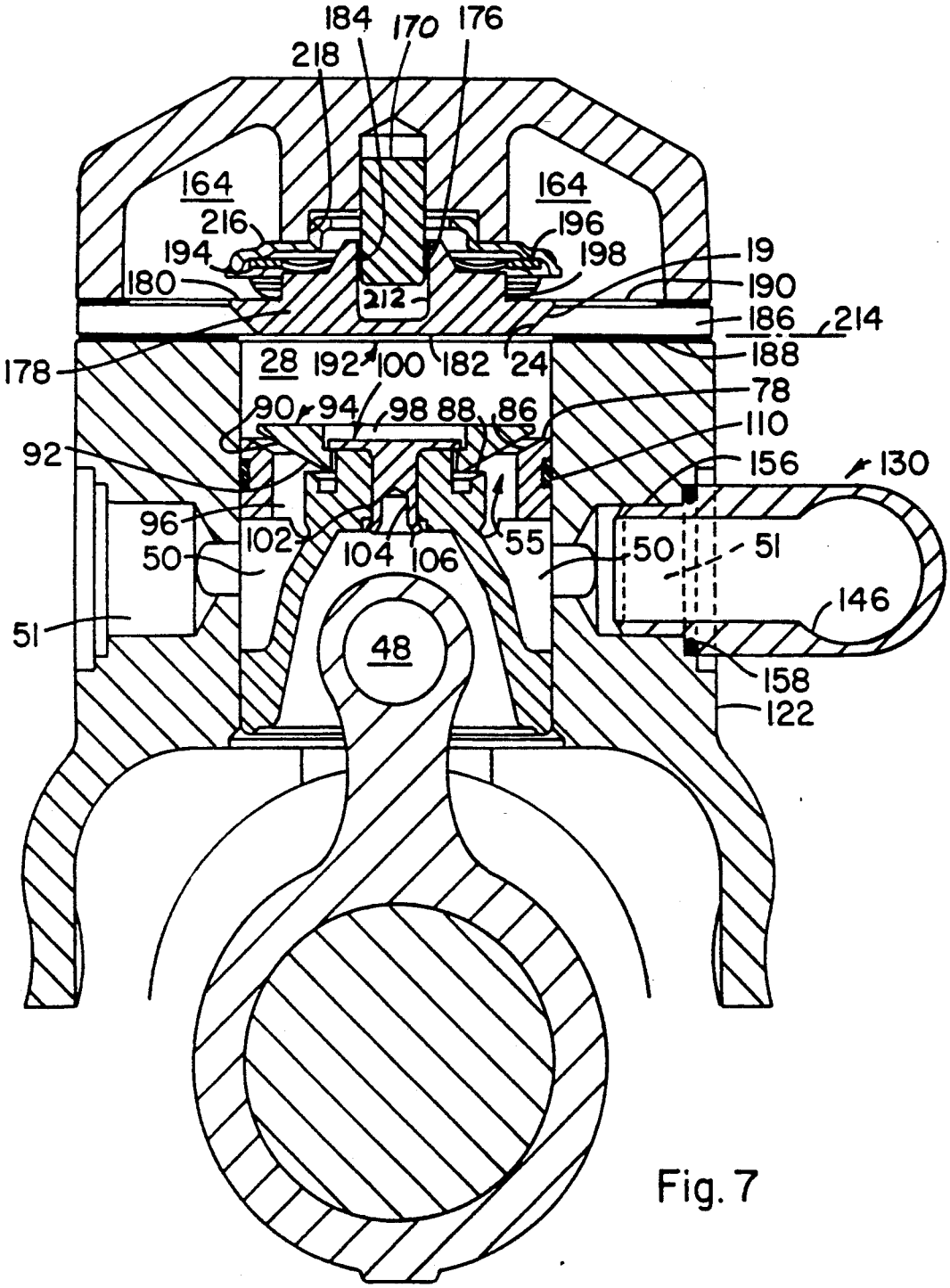
FIG. 7 shows a variation of the inlet or suction valve disc retainer means and suction port seat structure of FIG. 1, and novel discharge valve structure.

Referring to FIG. 7 which is approximately 1.5 times the actual dimensions of one particular model of the present compressor, a variation of the valve disc seat is shown as comprising double, substantially concentric annular seats or seat lands 86 and 88 which are adapted to seal against annular seats 90 and 92 respectively comprising portions of the beveled surface of valve disc 94, on the compression stroke. With the suction port aperture 55 thus sealed, the annular cavity 96 which is the equivalent of cavity 52 of FIG. 1, is completely closed off from compression chamber 28 even though the access opening 98 in the top of valve disc 94 is not sealed by any means such as access cover 74 as shown in FIG. 1. In this embodiment the metal retainer plate 100 is preferably in the form of a rivet, the shank 102 of which is recessed at 104 on the end and annularly spread deformed at 106 to tightly lock the retainer plate in position on the piston. Such retainer plate construction can also be employed with the disc of FIG. 1. It is particularly noted that on the compression stroke the upper surface 95 of disc 94 becomes planar with piston top 78.

Figure 8:
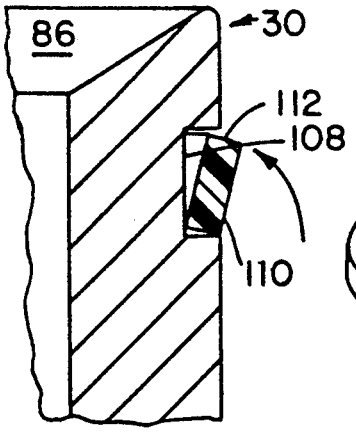
FIG. 8 is an enlarged view of a segment of the piston of FIG. 7 showing a flip seal in place in the wall thereof.
Figure 9:
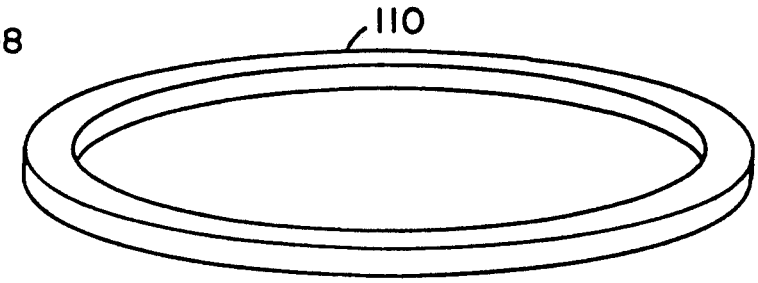
FIG. 9 is a prespective view of the seal of FIG. 8 in unassembled configuration.

Referring to FIGS. 8 and 9, the piston wall surface is provided with an annular piston ring groove 108 into which a flip seal 110 is held under considerable tension. This seal is preferably of a highly abrasive resistant and heat resistant material such as Teflon, polyamide or polyimide, and is normally configured as shown in FIG. 9. The inner diameter of the seal is less than the diameter of groove 108 such that when the seal is forced slid down over the piston and into the groove, the stretching forces on the inner diameter of the seal will cause its outer rim 112 to spring upwardly in an arc as indicated by the arrow in FIG. 8. Thus when the piston and seal are inserted into the cylinder, the seal will tend to outwardly flex to its posture as shown in FIG. 8 to thereby provide both compression and oil sealing against the cylinder wall which is important where such large inlet apertures as 50 are provided through the piston wall and the total piston wall surface thus greatly reduced in area.

Figure 10:
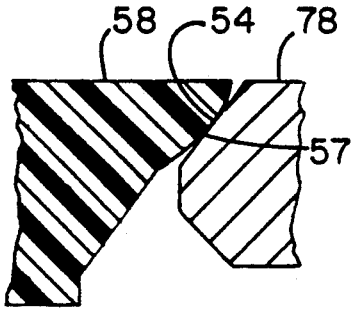
FIG. 10 is a cross-sectional view of a radiused or curved variation of the valve disc seat of FIG. 1.
Figure 11:
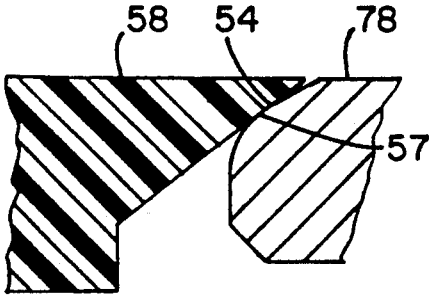
FIG. 11 is a cross-sectional view of a radiused or curved variation of the suction port seat of FIG. 1.

Referring to FIGS. 10 and 11, the valve disc seat 57 or the suction port seat 54, or both may be radiused or curved as shown, with the curve dimensions and configurations being selected to maintain the disc top and piston top in essentially the same plane when the suction port is closed on the compression stroke. It is particularly noted that the discharge valve and port seats 19 and 24 respectively may also be raduised or curved.

Figure 12:
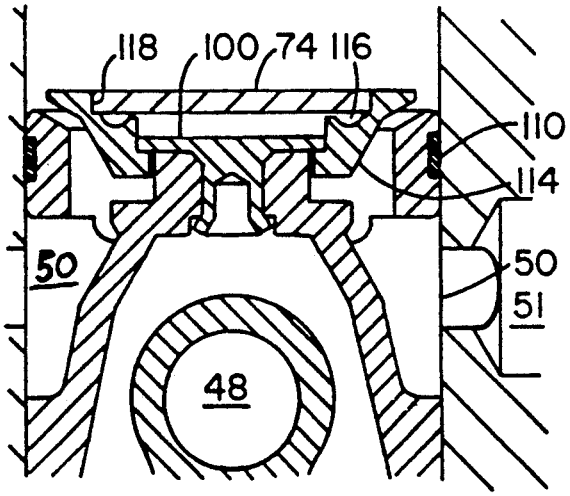
FIG. 12 shows a variation of the valve disc structure of FIG. 1.

Referring to FIG. 12, the upper portion of valve disc 114 is provided with an annular groove 116 underlying the access cover 74. In this embodiment, the access cover is sonic welded into recess 118, for example, at a vibration rate of about 30,000 Hertz by known means and methods. The groove 116 has been found to be quite important in this process for providing a space in which plastic residues or flashings from the welding process are captured.

Referring particularly to FIGS. 7 and 14–25 wherein certain structural components equivalent to those of FIGS. 1–13 are similarly numbered, a preferred embodiment of the overall compressor unit structural arrangement is shown as comprising a shell 120, compressor crankcase 122, compressor head 124, electric drive motor 126, discharge muffler 128, dual suction manifolds 130, 132 mounted on opposite sides of the head, a suction gas inlet plenum 134, individual suction tubes 136, 138 feeding the suction manifolds, and suction gas inlet 140 and discharge gas outlet 142 formed through the shell.

Each suction manifold is comprised preferably of plastic material such as Nylon, polyimide or the like and is formed to provide a plenum 144 defined by a smoothly curved interior wall 146, and a connecting stroke 148 for sealingly, frictionally receiving its associated suction tube. The manifold flanges 150 are adapted to be secured to the crankcase by bolts 152 or the equivalent, after the tubular connection segments 154, 156 have been frictionally, sealingly forced into their respective apertures 51 in the crankcase 122 as shown in FIG. 7. The sealing of the segments may be enhanced by the use of seals such as O-rings 158. It has been found that the smooth curvatures of interior wall 146 of the manifolds diminishes suction noise.

Referring especially to FIGS. 7, 17, 20, 21 and 22, and with particular reference to the claims hereof, the compressor head and discharge valve assembly comprises head body means 160 having wall means 162 formed to provide discharge cavity means 164, discharge outlet means 166 through said wall means, the outer periphery of said cavity means being bordered by substantially continuous, substantially planar mounting surface means 168 on said wall means, discharge valve stanchion means 170 integral with said wall means and projecting outwardly therefrom within said cavity means with the axis 172 of said stanchion means oriented substantially normal to the plane 174 of said mounting surface means 168, axially oriented bearing means 176 on said stanchion means, discharge valve disc means 178 having a discharge side 180 and a substantially planar compression side 182, disc seat means 19 on said disc means, said discharge side having bearing means 184 thereon oriented substantially normal to said compression side and adapted to slidably engage said bearing means 176 on said stanchion means for guided movement of said disc means axially of said stanchion means, discharge valve plate means 186 having a compression side 188 and a discharge side 190 and adapted for attachment to said body means juxtaposed said mounting surface means to provide closure means for said discharge cavity means 164, discharge port means 192 formed through said plate means and comprising port seat means 24 in axial alignment with said disc seat means, said port means adapted to be closed by contact of said port seat means with said disc seat means, and compression spring means 194 interposed between said disc means and said body means and resiliently urging said disc means toward said discharge port means.

The aforedescribed body means 160 and disc means 178 are provided with cooperating shoulder means 196, 198 adapted to laterally engage portions of the spring means 194 for further restricting relative lateral motion between the body means, disc means, and spring means in cooperation with bearing means 176 and 184. Greatly enhanced accuracy of operation and longevity of the discharge valve disc is thus achieved.

The spring means preferably comprises a multi-coil helical spring as shown in FIG. 25, and wherein one of the aforesaid shoulder means 210 is positioned to engage inner peripheral portions of said spring, and the other of the shoulder means is positioned to engage outer peripheral portions thereof. The coils of the spring have a rectangular cross-section with the major cross-section dimension lying in a plane 200 substantially normal to the spring axis 202. In relaxed condition of the spring, each of its coils is in angularly spaced, multiple contact with an adjacent coil, and the end coils are also in such contact, each with one of the body means or the discharge side of the disc means. Perferably the angular spacing of the multiple contacts is about 120 degrees, and the ratio of the length of the compressions spring in relaxed unassembled condition to the maximum travel of the disc means in assembled condition is from about 2.0 to about 5.3.

Referring to the head body means, the body wall means has a floor portion 204 integral with and surrounded by side 206 and end 208 portions projecting outwardly therefrom substantially normal to the plane of mounting surface means 168. The stanchion means 170 comprises a shaft supported by and projecting from a boss 210 integral with and outwardly projecting from floor portion 204, and the bearing means 184 on disc means 178 comprises a shaft bore 212 formed substantially axially in the discharge side of the disc means and oriented substantially normal to the plane 214 of the inlet side thereof. The shoulder means on the body means is preferably provided by formed metal retainer 216 friction pressed into recess 218 in the boss.

The body is preferably formed to provide opposed lateral wall segments 220, 222 extending from opposed portions of the wall means 162 into cavity means 164 intermediate adjacent ones of the discharge valve stanchion means, the outer surfaces 224 of the segments forming part of the mounting surface means, and the laterally disposed inner edges 225 of the segments being spaced from each other to provide a discharge plenum continuum.

In a preferred embodiment, the body wall means is provided with at least two radially compressible, locator sleeves 226 extending outwardly from spaced portions of the mounting surface means substantially normal thereto, and the plate means 186 is provided with complimentary locator apertures 228 for frictionally, compressible receiving the sleeves. The relative positions of the sleeves and the plate apertures function to axially align the discharge port seat means with the disc the seat means upon attachment of said plate means to said body means in said juxtaposed relationship to the mounting surface means. Also, such frictional attachment of the plate and head greatly facilitates assembly of the head and discharge valve components to the compressor crankcase. Preferably, the sleeves or apertures, or both, are provided with tapered leading edges to facilitate assembly.

Referring to FIG. 24, the wrist pin retainer disc 230 shown in assembled position in FIG. 17 is of Teflon or the like and is employed to maintain the wrist pin in substantially centered position for easy assembly of the piston into the cylinder and also for preventing the wrist pin from rubbing against the cylinder wall during compressor operation. It is noted that conventionally the wrist pin is not press fitted into the cylinder wall or the connecting rod, and therefore, would normally tend to slide downwardly during compressor operation as viewed in FIG. 17. The Teflon retainer disc is slightly circumferentially compressed in its gap 232 during installation thereof into the wrist pin bearing bore 234 and has sufficient resiliency to expand against the bore wall to maintain its position therein as shown in FIG. 17. In the event, however, that the wrist pin eventually moves downwardly, the retainer, being of Teflon on the like, will readily provide a sliding, long lasting, bearing means and prevent contact of the end of the wrist pin with the cylinder wall. For the size of retainer disc shown in FIG. 24, its thickness is preferably from about 0.032 to about 0.038 inchs.

At this point the preference for the plastic material for the suction valve disc and also for the discharge valve disc, and for their construction as shown is emphasized for the reasons that (1) their construction and light weight allow them to open and close with greatly reduced inertia, i.e., requiring very little energy, (2) contact of these discs with their metal seats and with each other produces little noise, (3) the closing force exerted by spring 22 can be very light since the total evacuation of the pressurized refrigerant from chamber 28 essentially eliminates any dynamic pressure drop across the discharge port which the spring would have to overcome, (4) liquid slugging would have little if any tendency to damage the valves such as can easily occur with metal reed and other types of flex valving, (5) the essentially total discharge of compressed gases from the compression chamber eliminates energy loss through refrigerant reexpansion on the suction stroke, and (6) the extraordinarily capacious inlet and discharge porting provided by this unique construction greatly reduces the energy required to move the desired volumes of refrigerant through the system.

As stated above, various configurations and shapes of the structural components of the present invention may be varied, e.g., the piston, cylinder, valve discs and the like may be of any configuration known to the art such as oval, square, rectangular or the like, however the shapes shown herein are preferred.

The invention has been described in detail with particular reference to preferred embodiments thereof, but it will be understood that variations and modifications will be effected within the spirit and scope of the invention.

We claim:

1. A gas compressor having block means with cylinder means formed therein, piston means mounted for reciprocation in said cylinder means, cylinder head means mounted on said block means over the end of said cylinder means to provide discharge chamber means, gas discharge valve means intermediate said head and cylinder means defining compression chamber means and providing discharge passage means and valve means therein adapted to open said discharge passage means to said discharge chamber means for pressurized gas on the compression stroke of said piston means and to close said discharge passage means on the suction stroke of said piston means, first suction gas inlet means through the wall of said cylinder means at a position remote from said cylinder head means, second suction gas inlet passage means in said piston means extending through the outer wall thereof and into communication with said first passage means over at least a substantial portion of the travel of said piston means, suction gas port means in the top of said piston means in communication with said second passage means, said port means comprising suction port means defining an aperture through the top of said piston means, wherein said suction port seat means comprises two radially spaced and substantially concentric seat lands between which the suction gas flows into the compression chamber during the suction stroke, and suction valve disc means mounted in the upper portion of said piston means for limited axial, floating movement and having disc seat means adapted to bear against said suction port seat means on the compression stroke of said piston means to close off said second passage means from said compression chamber, said floating movement being sufficient for movement of said disc seat means away from said suction port seat means to provide said suction gas port means with suitable open dimensions to allow adequate low-pressure refrigerant gas flow into said compression chamber during the suction stroke of said piston means, said cylinder head means comprising body means having wall means formed to provide said discharge chamber means, discharge outlet means through said wall means, the outer peripheral portions of said cavity means being bordered by substantially continuous, substantially planar mounting surface means on said wall means, discharge valve stanchion means integral with said wall means projecting axially outwardly therefrom within said cavity means in a direction substantially normal to the plane of said mounting surface means, said discharge valve means comprising discharge valve disc means having a discharge side and an inlet side, discharge valve disc seat means on the inlet side of said disc means, said discharge side of said discharge valve disc means having axially oriented bearing means thereon adapted to slidably engage axially oriented bearing means on said stanchion means for guided movement of said discharge valve disc means axially of said stanchion means, said discharge valve means further comprising discharge valve plate means having an inlet side and a discharge side and attached to said compressor intermediate said mounting surface means of said body means and said block means to provide closure means for said discharge chamber means, discharge port means formed through said plate means and comprising discharge port seat means in axial alignment with said discharge valve disc seat means, said discharge port means adapted to be closed by contact of said discharge port seat means with said discharge valve disc seat means, and compression spring means interposed between said discharge valve disc means and said body means and resiliently urging said disc means toward said discharge port means.

2. The compressor of claim 1 wherein said seat means of either or both of said discharge or suction port means, or either or both of said discharge or suction valve disc means is beveled or curved.

3. The compressor of claim 1 wherein said suction valve disc means comprises a circular valve disc body having a suction side and a substantially planar compression side, said sides being substantially planar and substantially parallel to each other, a circular bore extending axially through said body and said sides, and shoulder means on the wall of said bore adjacent said suction side, the periphery of said body having a beveled or curved disc seat, the bend or curve extending in a generally radially inward direction from adjacent said compression side toward said suction side.

4. The compressor of claim 1 wherein the upper portion of said piston is provided with axially oriented projection means lying radially and axially inward of said port seat means, said valve disc body being positioned on said piston means with said projection means slidably extending generally axially within said bore from said suction side to a short distance above said shoulder means of said bore, and retainer means on said projection means extending over the upper surface of said shoulder means and limiting the upper axial motion of said disc means away from said suction port seat means, the compression side of said retainer lying substantially in the plane of the compression side of said valve disc body during the compression stroke.

5. The compressor of claim 4 wherein the compression side valve of said disc body is provided with cover means sealing the upper end of said bore.

6. The compressor of claim 5 wherein said cover means is sonic welded to said valve disc body and having its compression side lying substantially in the plane of the compression side of said body.

* * * * *